US007574353B2

(12) United States Patent
Trombetta et al.

(10) Patent No.: US 7,574,353 B2
(45) Date of Patent: Aug. 11, 2009

(54) TRANSMIT/RECEIVE DATA PATHS FOR VOICE-OVER-INTERNET (VOIP) COMMUNICATION SYSTEMS

(75) Inventors: Ramon Cid Trombetta, Garland, TX (US); Timothy James O'Gara, Carrollton, TX (US)

(73) Assignee: LSI Logic Corporation, Milpitas, CA (US)

( * ) Notice: Subject to any disclaimer, the term of this patent is extended or adjusted under 35 U.S.C. 154(b) by 597 days.

(21) Appl. No.: 10/991,844

(22) Filed: Nov. 18, 2004

(65) Prior Publication Data

US 2006/0106598 A1 May 18, 2006

(51) Int. Cl.
*G10L 11/06* (2006.01)
*G10L 19/00* (2006.01)

(52) U.S. Cl. ..... 704/215; 704/201; 704/210

(58) Field of Classification Search ..... None
See application file for complete search history.

(56) References Cited

U.S. PATENT DOCUMENTS

| | | | | |
|---|---|---|---|---|
| 5,689,615 | A * | 11/1997 | Benyassine et al. | 704/219 |
| 6,240,383 | B1 * | 5/2001 | Tanaka | 704/219 |
| 6,374,211 | B2 * | 4/2002 | Stegmann et al. | 704/211 |
| 2005/0055116 | A1 * | 3/2005 | Isaka et al. | 700/94 |

OTHER PUBLICATIONS

G.729AB Technical Specification, available at http://www.ittiam.com/pages/products/g729-ab.htm, Jun. 2002.*

Benyassine, A et al. "ITU-T Recommendation G.729 Annex B: A Silence Compression Scheme for Use with G.729 Optimized for V.70 Digital Simultaneous Voice and Data Applications" IEEE Communications Magazine, Sep. 1997.*

Serizawa et al. A Silence compression algorithm for multi-rate/dual-bandwidth mpeg-4 CELP standard, Acoustics Speech and Signal Processing Jun. 2000.*

Beritelli et al. "Intrastandard hypbrid speech coding for adaptive IP telephoney" Qos-IP pp. 173-187 2001.*

* cited by examiner

*Primary Examiner*—Matthew J Sked
(74) *Attorney, Agent, or Firm*—Yee & Associates, P.C.

(57) ABSTRACT

The present invention is a method and apparatus in a data processing system that includes a Voice over Internet Protocol (VoIP) communication system for improving transmit and receive data paths. The communication system includes a digital signal processing unit. The digital signal processing unit includes a mandatory coder/decoder (codec) that does not include an internal packet loss concealment (PLC) function, an internal voice activity detection (VAD) function, an internal comfort noise generation (CNG) function, or an internal discontinuous transmission generation (DTX) function. The digital signal processing unit also includes an enhanced codec that includes any combination of the following modules all internal to the enhanced codec: internal packet loss concealment (PLC) function, a voice activity detection (VAD) function, a comfort noise generation (CNG) function, and a discontinuous transmission generation (DTX) function. The digital signal processing unit does not include a separate packet loss concealment (PLC) module, a separate voice activity detection (VAD) module, a separate comfort noise generation (CNG) module, or a separate discontinuous transmission generation (DTX) module. An input signal is received within the digital processing unit. A determination is made regarding whether the input signal includes voice data. If the input signal does include voice data, the input signal is processed utilizing the mandatory codec. If the input signal does not include voice data, the input signal is processed utilizing the enhanced codec.

24 Claims, 8 Drawing Sheets

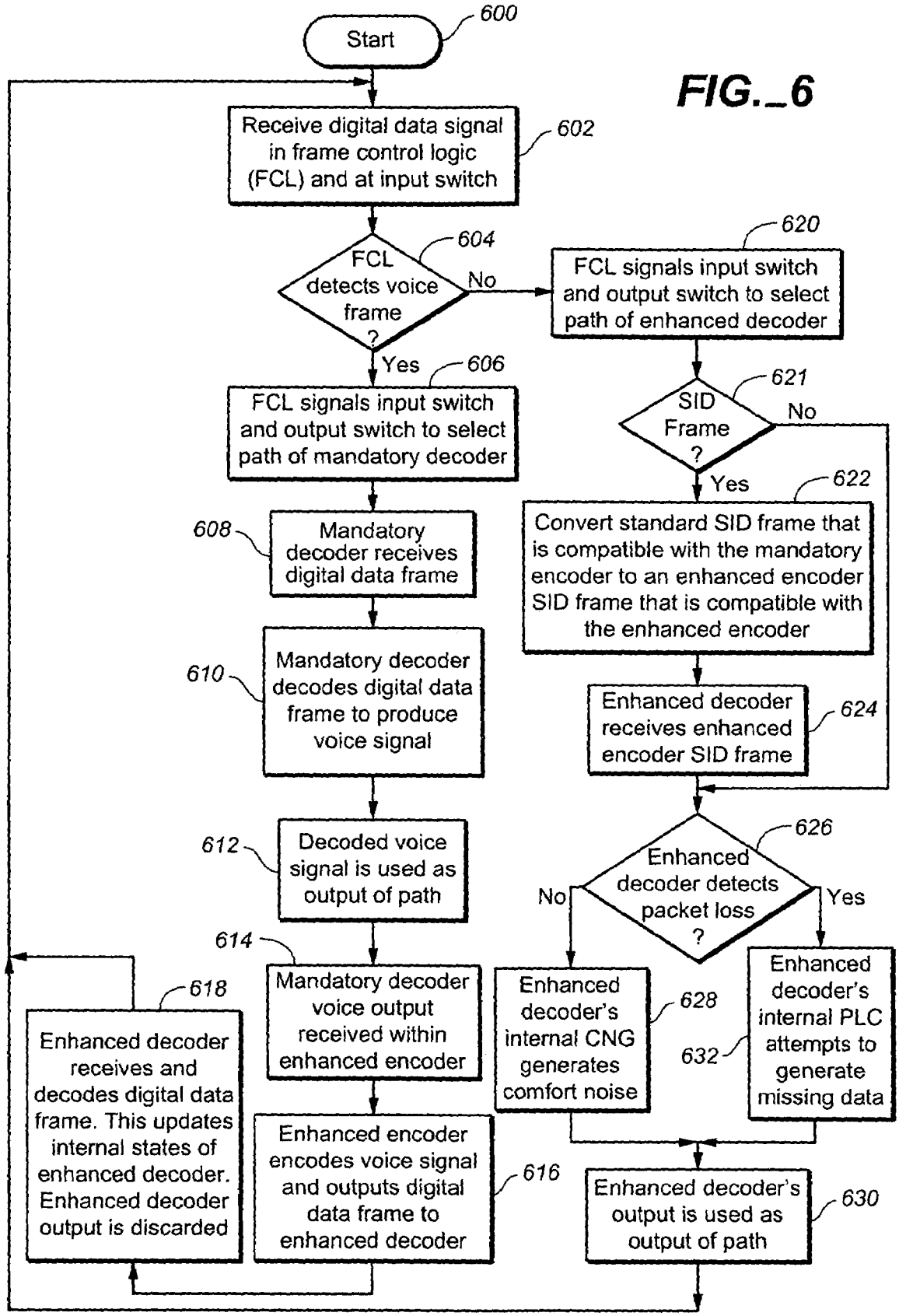
FIG._6
Start
600
Receive digital data signal in frame control logic (FCL) and at input switch
602
FCL detects voice frame ?
604
No
Yes
FCL signals input switch and output switch to select path of enhanced decoder
620
FCL signals input switch and output switch to select path of mandatory decoder
606
SID Frame ?
621
No
Yes
Convert standard SID frame that is compatible with the mandatory encoder to an enhanced encoder SID frame that is compatible with the enhanced encoder
622
Mandatory decoder receives digital data frame
608
Mandatory decoder decodes digital data frame to produce voice signal
610
Enhanced decoder receives enhanced encoder SID frame
624
Decoded voice signal is used as output of path
612
Enhanced decoder detects packet loss ?
626
No
Yes
Mandatory decoder voice output received within enhanced encoder
614
Enhanced decoder receives and decodes digital data frame. This updates internal states of enhanced decoder. Enhanced decoder output is discarded
618
Enhanced decoder's internal CNG generates comfort noise
628
Enhanced decoder's internal PLC attempts to generate missing data
632
Enhanced encoder encodes voice signal and outputs digital data frame to enhanced decoder
616
Enhanced decoder's output is used as output of path
630

800
802
Processor
804
Processor
806
System Bus
808
Memory Controller/ Cache
810
I/O Bridge
809
Local Memory
814
PCI Bus Bridge
PCI Bus 816
818
Modem
820
Network Adapter
MAC 880
Physical Layer 882
I/O Bus 812
830
Graphics Adapter
822
PCI Bus Bridge
PCI Bus 826
832
Hard Disk
824
PCI Bus Bridge
PCI Bus 828

TRANSMIT/RECEIVE DATA PATHS FOR VOICE-OVER-INTERNET (VOIP) COMMUNICATION SYSTEMS

BACKGROUND OF THE INVENTION

1. Technical Field

The present invention is directed generally toward voice processing systems. More particularly, the present invention relates to a method and apparatus in a Voice over Internet Protocol (VoIP) communication system for improving transmit and receive data paths.

2. Description of the Related Art

There is an increasing demand for Voice over Internet Protocol (VoIP) solutions for use in home and office. VoIP systems transmit voice communications between two computer systems using a data network using the Internet Protocol instead of via a traditional telecommunications network such as the Public Switched Telephone Network (PSTN) or Private Branch Exchange (PBX). A VoIP system receives voice and fax signals, converts them into digital data, and transmits the digital data over a computer network using the IP standard.

Typically, a transmitting VoIP system receives digital voice input within a digital signal processor (DSP) which encodes the digital voice to produce compressed data and outputs the compressed data. Conversely, a receiving VoIP system also includes a digital signal processor (DSP) which receives the compressed data, converts it back to digital voice, and then outputs the digital voice.

A coder/decoder (codec) is a module that converts linear voice data to produce compressed data and converts compressed data to produce linear voice. Most VoIP systems have a list of codecs that can be used. This is primarily due to the different quality and bit-rate tradeoffs among the different codecs. A codec includes both an encoder and a decoder.

However, the G.711 codec is mandatory for all VoIP systems. The G.711 codec lacks any packet loss concealment (PLC), voice activity detection (VAD), discontinuous transmission (DTX), and comfort noise generation (CNG) functionality.

Many VoIP applications require these PLC, VAD, DTX, and CNG functions. When an application requires these functions, an additional stand-alone module must be provided in the DSP to provide each PLC, VAD, DTX, and CNG function. The additional modules take up valuable hardware real estate within the system.

FIG. 1 is a block diagram of a transmit data path included within a digital signal processor (DSP) in a Voice over Internet Protocol (VoIP) system in accordance with the prior art. A DSP device 100 includes a transmit data path 101. DSP 100 is included within a VoIP system. Data path 101 includes a mandatory codec 102, such as a G.711 encoder, a separate module that provides a discontinuous transmission generator function DTX 104, a separate module that provides a voice activity detector function VAD 106, and an enhanced codec, such as enhanced encoder 108 that adheres to the ITU G.729AB standard. Enhanced encoder 108 includes within it an internal DTX and an internal VAD. According to the prior art, a voice signal is received within either enhanced encoder 108 or VAD 106 as selected by a codec select switch 110. If the mandatory codec is selected by switch 110, VAD 106 receives the input signal and determines whether voice is present in the received signal. If voice is detected in the signal, VAD 106 selects mandatory encoder 102 which encodes the voice signal to produce an output data signal. The output of encoder 102 is then the output of DSP 100. If voice is not detected in the signal, VAD 106 selects DTX 104 which produces silence description frames as the output data signal. The output of DTX 104 is then the output of DSP 100. VAD 106 continues to select either encoder 102 or DTX 104 as the continuous input signal is received depending on whether voice is detected or not currently in the input stream in order to product a continuous stream of digital data output.

FIG. 2 is a block diagram of a receive data path included within a digital signal processor (DSP) in a Voice over Internet Protocol system in accordance with the prior art. A DSP device 200 includes a receive data path 201. DSP 200 is included within a VoIP system. Data path 201 includes a mandatory codec 202, such as an decoder G.711, a separate module that provides a comfort noise generator function CNG 204, a separate module that provides a packet loss concealment function PLC 206, and an enhanced codec, such as enhanced decoder 208 that adheres to the G.729AB standard. Enhanced decoder 208 includes within it an internal PLC and an internal CNG. According to the prior art, a data signal is received within either enhanced encoder 208 or both mandatory decoder 202 and CNG 204 as selected by a codec select switch 210. If the mandatory codec and CNG path is selected by switch 210, mandatory decoder 202 and CNG 204 receive the input signal. If the input data signal is transmitted silence, CNG 204 inserts comfort noise. If the input data signal includes a voice frame, mandatory decoder 202 decodes the voice frame to produce a voice output signal. In the case of data packet loss where no voice data is present and the input data signal is neither transmitted nor untransmitted silence, PLC 206 attempts to extrapolate voice data to fill in the gap when the voice output signal is produced.

Modem DSP devices sometimes include codecs in addition to the mandatory G.711 codec. For example, an enhanced codec, e.g. codec G.729AB, was provided in the DSP in both FIGS. 1 and 2. These other non-mandatory codecs often include the PLC, VAD, DTX, and CNG functions within the codec itself. The G.729AB codec includes within it an internal PLC, VAD, DTX, and CNG. Therefore, these DSP devices include a G.711 codec, a separate PLC module, a separate VAD module, a separate DTX module, a separate CNG module, and a non-mandatory codec that includes within it internal PLC, VAD, DTX, and CNG functions.

Therefore, a need exists for a method and apparatus for improving transmit and receive data paths in a Voice over Internet Protocol communication system by removing duplicated functional modules from a digital signal processing unit that includes a mandatory codec as well as an enhanced codec that includes these functions internally.

SUMMARY OF THE INVENTION

The present invention is a method and apparatus in a data processing system that includes a Voice over Internet Protocol (VoIP) communication system for improving transmit and receive data paths. The communication system includes a digital signal processing unit. The digital signal processing unit includes a mandatory coder/decoder (codec) that does not include an internal packet loss concealment (PLC) function, an internal voice activity detection (VAD) function, an internal comfort noise generation (CNG) function, or an internal discontinuous transmission generation (DTX) function. The digital signal processing unit also includes an enhanced codec that includes any combination of the following modules all internal to the enhanced codec: internal packet loss concealment (PLC) function, a voice activity detection (VAD) function, a comfort noise generation (CNG) function, and a discontinuous transmission generation (DTX) function. The digital signal processing unit does not include a separate packet loss concealment (PLC) module, a separate voice activity detection (VAD) module, a separate comfort noise generation (CNG) module, or a separate discontinuous transmission generation (DTX) module. An input signal is received within the digital processing unit. A determination is made regarding whether the input signal includes voice data. If the input signal does include voice data, the input signal is processed utilizing the mandatory codec. If the input signal does not include voice data, the input signal is processed utilizing the enhanced codec.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 6 depicts a high level flow chart that illustrates receiving a compressed digital data signal and transmitting a linear voice signal utilizing the improved receive data path of FIG. 4 in accordance with the present invention;

DETAILED DESCRIPTION

The description of the preferred embodiment of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention to enable others of ordinary skill in the art to understand the invention for various embodiments with various modifications as are suited to the particular use contemplated.

Figure 1:
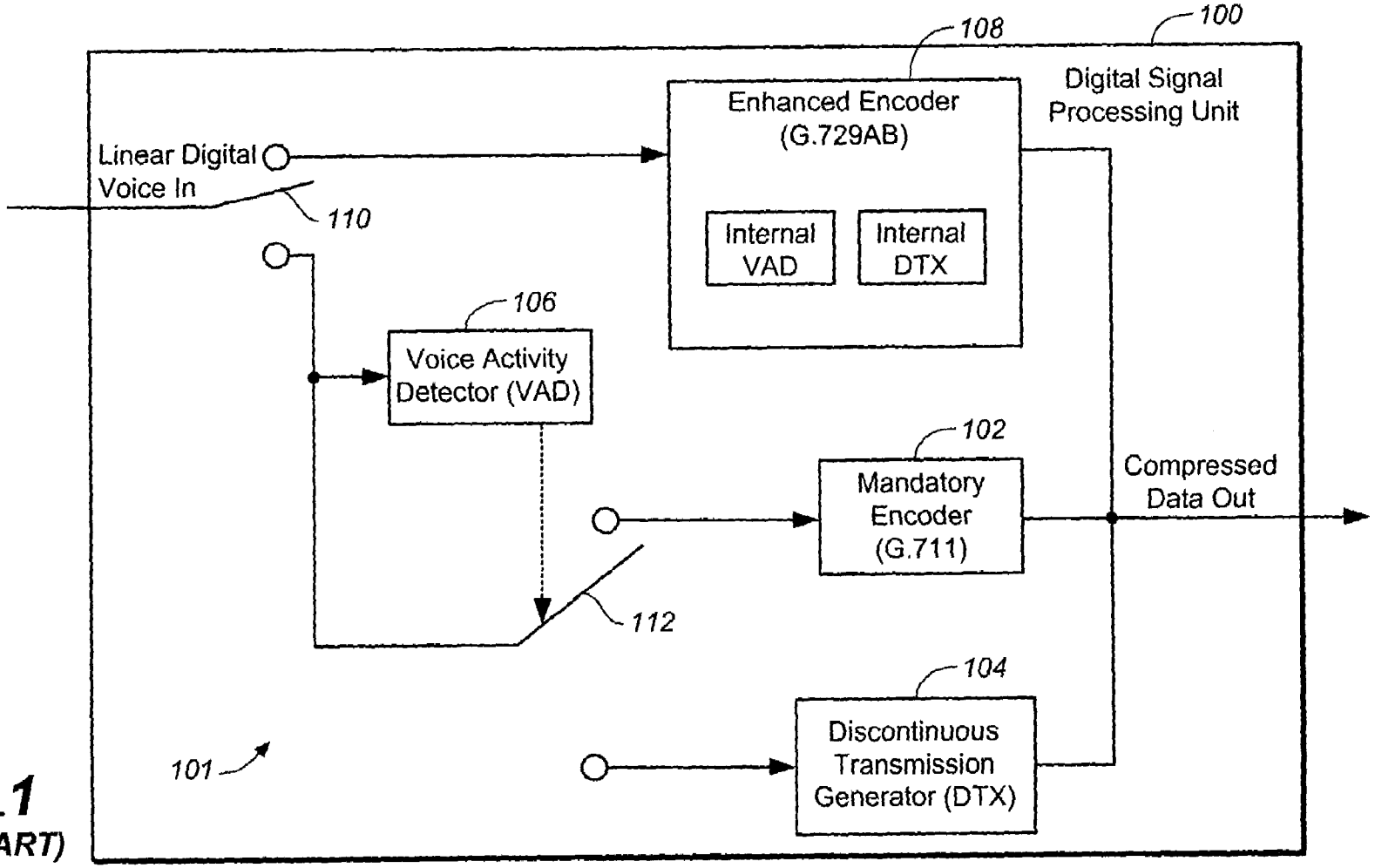
FIG. 1 (PRIOR ART)
FIG. 1 is a block diagram of a transmit data path included within a digital signal processor (DSP) in a Voice over Internet Protocol system in accordance with the prior art.
Figure 2:
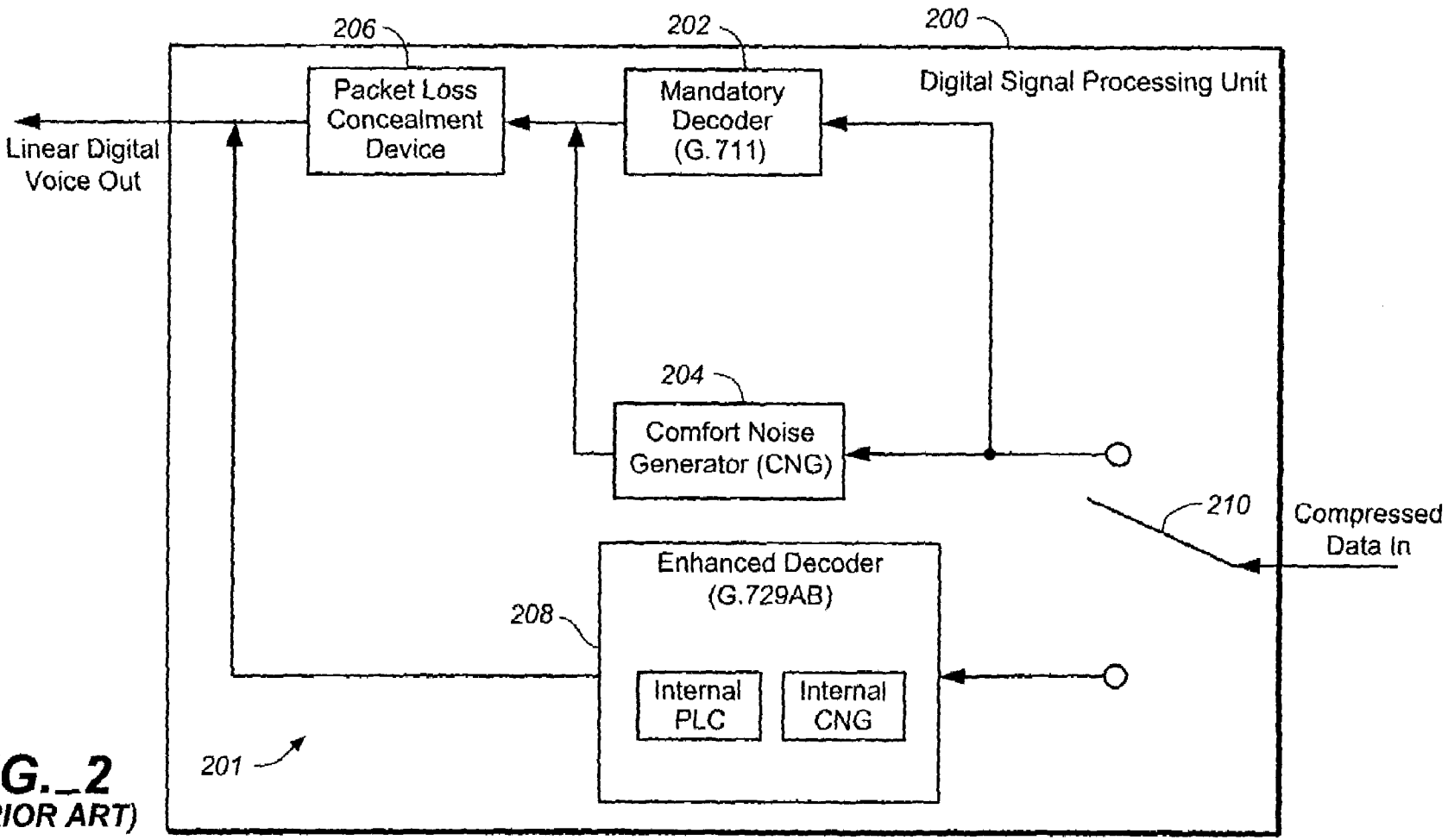
FIG. 2 (PRIOR ART)
FIG. 2 is a block diagram of a receive data path included within a digital signal processor (DSP) in a Voice over Internet Protocol system in accordance with the prior art.
Figure 3:
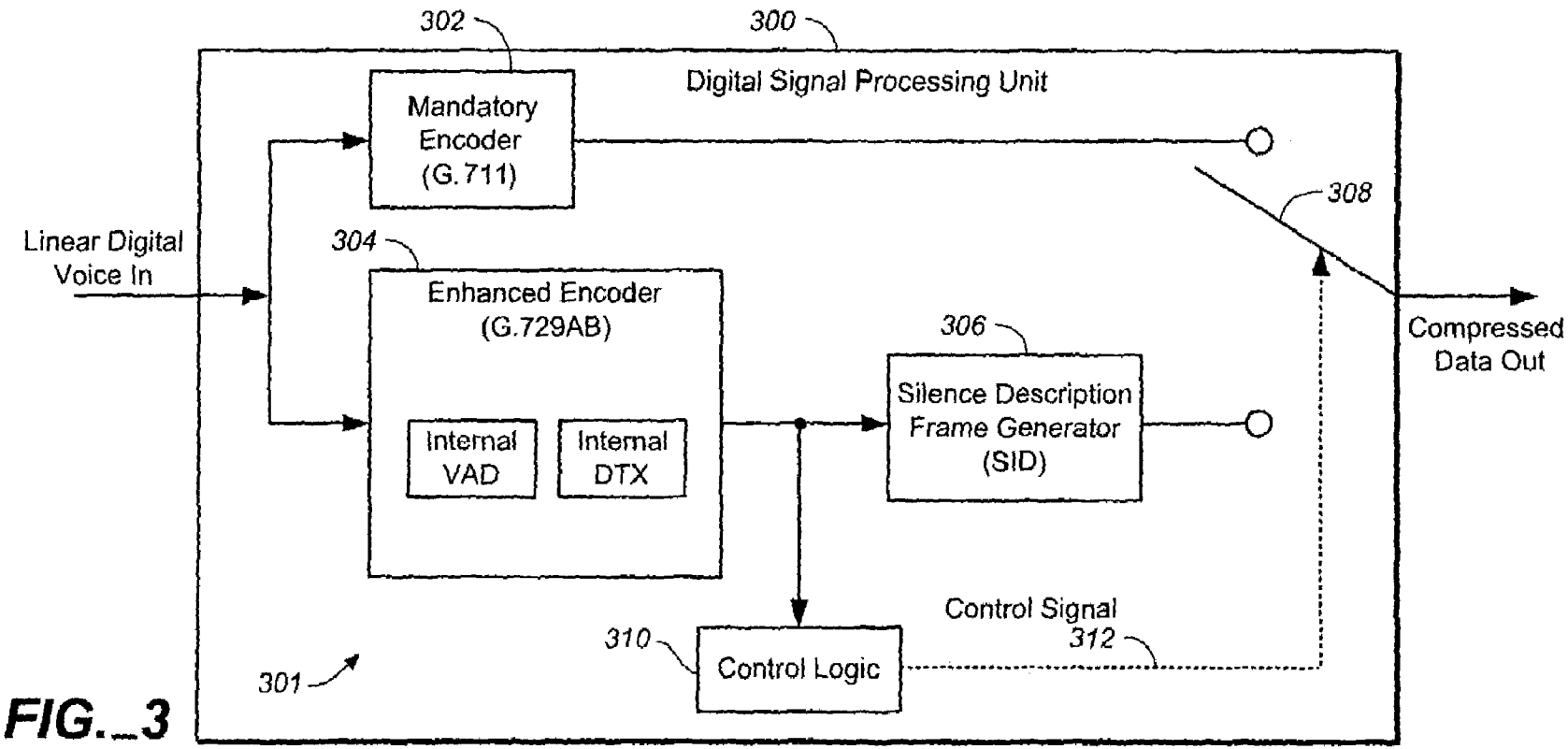
FIG. 3 is a block diagram of an improved transmit data path included within a digital signal processor (DSP) in a Voice over Internet Protocol system in accordance with the present invention.

FIG. 3 is a block diagram of an improved transmit data path included within a digital signal processor (DSP) in a Voice over Internet Protocol system in accordance with the present invention. A DSP device 300 includes a transmit data path 301. DSP 300 is included within a VoIP system. Data path 301 includes a mandatory codec 302, such as an encoder G.711, and an enhanced codec, such as enhanced encoder 304 that adheres to the G.729AB standard. Although the enhanced codec includes both an enhanced encoder and an enhanced decoder, only the enhanced encoder is described herein as the enhanced decoder's functions are not utilized in the transmit data path. Data path 301 also includes a silence description frame generator SID 306, a switch 308, and control logic 310. Enhanced encoder 304 includes within it an internal DTX, an internal VAD, an internal DTX, and an internal CNG.

According to the present invention, linear voice data is received within both mandatory encoder 302 and enhanced encoder 304. Both mandatory encoder 302 and enhanced encoder 304 attempt to encode the received voice data. If the VAD that is internal to the enhanced encoder 304 detects voice in the input data, control logic 310 outputs a control signal 312 that causes switch 308 to close to select the path of the mandatory encoder 302. The control logic is enhanced codec dependent and is used to determine if the voice data received is coded voice or silence. This is typically done by analyzing the output of the enhanced codec. If the VAD that is internal to the enhanced encoder 304 detects silence in the input signal, control logic 310 outputs a control signal 312 that causes switch 308 to close to select the path of the enhanced encoder 304. The DTX that is internal to the enhanced encoder 304 then generates a silence description frame that conforms to the G.729AB standards. This frame is then output from enhanced encoder 304 and received within SID 306. SID 306 performs the necessary conversion from the enhanced codec SID frame to the format required for the VoIP system. For example, a format often required in VoIP is described in IETF RFC 3389, "Real-time Transport Protocol (RTP) for Comfort Noise (CN)". This silence frame is then transmitted as digital data out of the DSP 300.

Those skilled in the art will recognize that an additional transmit data path exists within DSP 300. In this additional transmit data path, enhanced encoder 304 receives the linear digital voice input. Enhanced encoder 304 then generates a compressed data output. This compressed data output is then made available to be selected by switch 308. This additional transmit data path is known in the art and is not depicted by FIG. 3 or described below.

Figure 4:
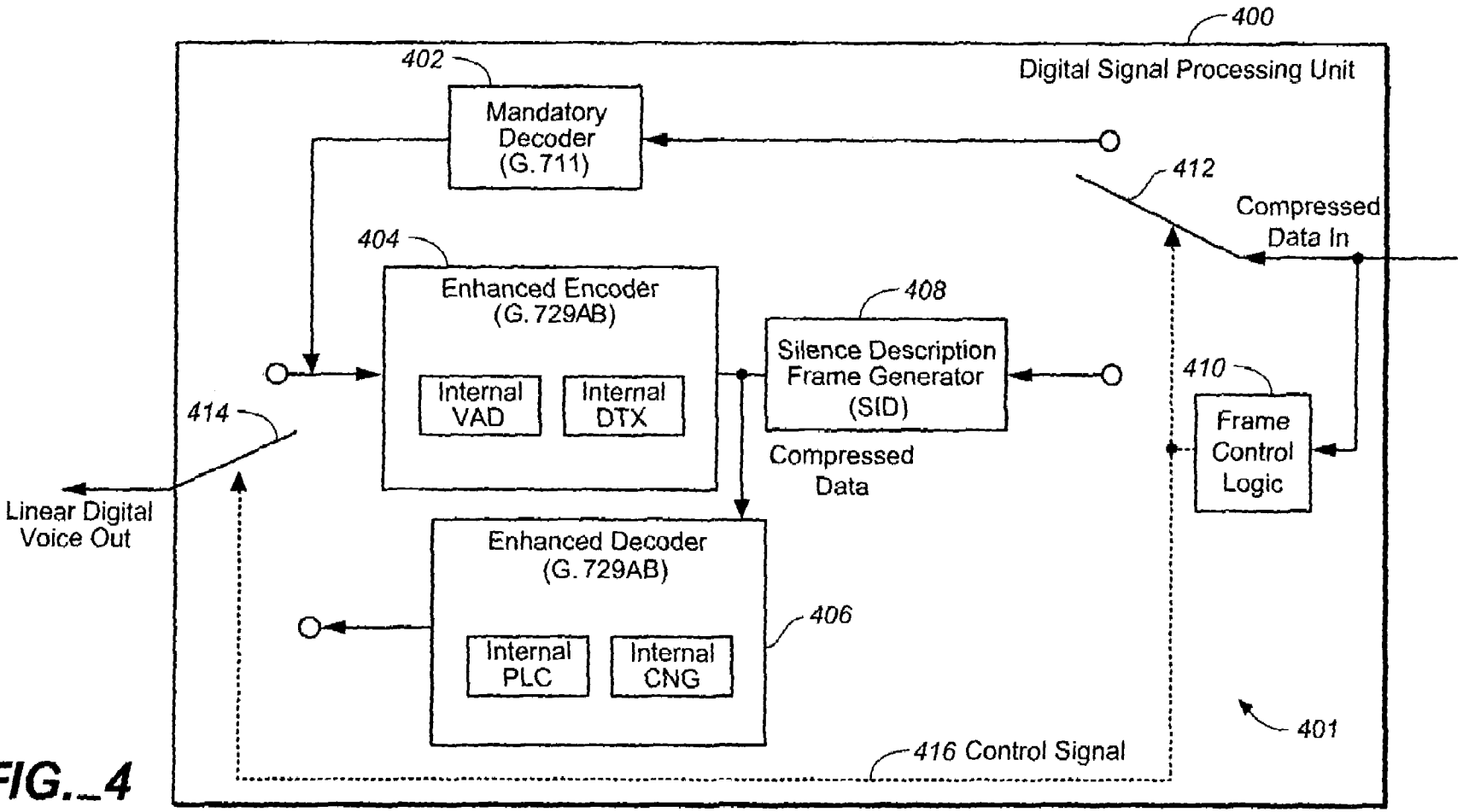
FIG. 4 is a block diagram of an improved receive data path included within a digital signal processor (DSP) in a Voice over Internet Protocol system in accordance with the present invention.

FIG. 4 is a block diagram of an improved receive data path included within a digital signal processor (DSP) in a Voice over Internet Protocol system in accordance with the present invention. A DSP device 400 includes a receive data path 401. DSP 400 is included within a VoIP system. Data path 401 includes a mandatory codec 402, such as a decoder G.711, an enhanced encoder 406 and an enhanced decoder 404 that both adhere to the G.729AB standard, a silence description frame generator 408, frame control logic 410, an input switch 412, and an output switch 414. Enhanced encoder 404 includes an internal DTX and an internal VAD. Enhanced decoder 406 includes an internal PLC and an internal CNG.

Those skilled in the art will recognize that a single enhanced codec, that includes both an enhanced encoder and enhanced decoder, may be utilized to provide the functionality described herein of the enhanced encoder 404 and the enhanced decoder 406.

According to the present invention, compressed data is received within frame control logic 410 and at input switch 412. If frame control logic 410 detects that the input data signal includes a voice frame, frame control logic 410 outputs control signal 416 to cause switch 412 and switch 414 to both select the path that includes the mandatory decoder 402.

Mandatory decoder 402 then receives the compressed data, decodes the received compressed data, and outputs a linear digital voice signal. This linear digital voice signal is then used as the output of receive path 401.

In addition, the voice signal is then input into enhanced encoder 404 which encodes the linear digital voice signal to produce compressed data. The compressed data is then received in enhanced decoder 406. Enhanced decoder 406 receives and decodes the compressed data. The output of enhanced decoder 406 is then discarded. This step of having the enhanced decoder 406 decode the compressed data causes the internal states of the enhance decoder to be updated properly. The internal state updates are needed for proper PLC functionality.

If frame control logic 410 detects that the input data signal does not include a voice frame, frame control logic 410 outputs control signal 416 to cause switch 412 and switch 414 to both select the path that includes the enhanced decoder 406. The input compressed data is received by SID 408 which converts the silence data frame that is compatible with the standard of the G.711 to a silence data frame that is compatible with the standard of the G.729AB. SID 408 then outputs a silence data frame that is compatible with the standard of the G.729AB. This silence frame signal is received within enhanced decoder 406 which uses its internal PLC to determine if any packet loss occurred. If any packet loss did occur, the PLC internal to enhanced decoder 406 then attempts to generate the missing voice signal. If no packet loss is detected, the CNG that is internal to enhanced decoder 406 then inserts comfort noise. The output of enhanced decoder 406 is then used as the output of receive path 401.

As depicted by FIGS. 3 and 4, separate PLC, VAD, DTX, and/or CNG modules are not included in DSP 300 or DSP 400.

Those skilled in the art will recognize that an additional receive data path exists within DSP 400. This additional receive data path may be selected utilizing switch 412. In this additional receive data path, the compressed data input signal is received within enhanced decoder 406. Enhanced decoder 406 then generates a linear digital voice output signal. This linear voice output signal is then made available to be selected by switch 414. This additional receive data path is known in the art and is not depicted by FIG. 4 or described below.

Figure 5:
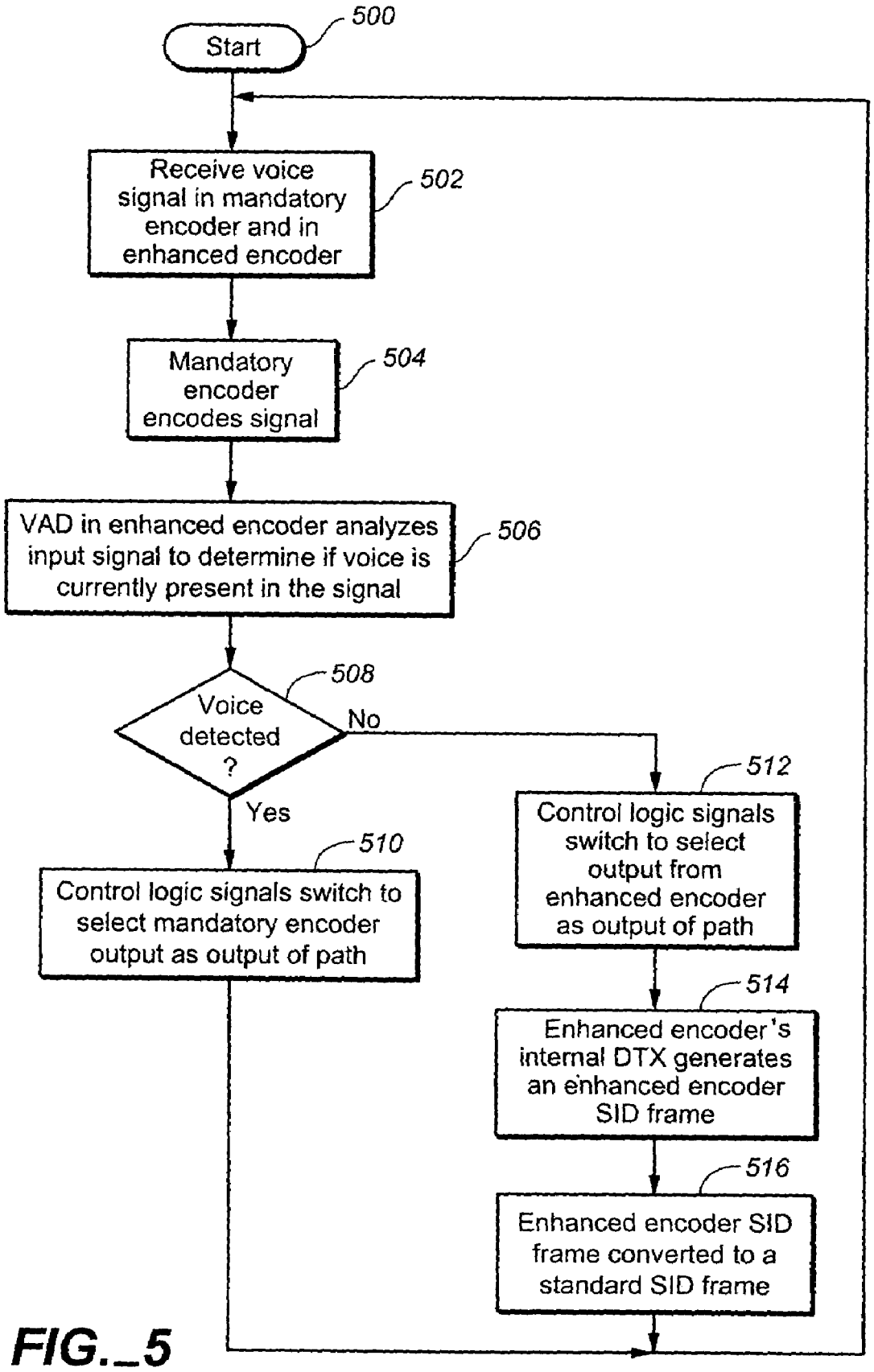
FIG. 5 depicts a high level flow chart that illustrates receiving a linear digital voice signal and transmitting a compressed digital data signal utilizing the improved transmit data path of FIG. 3 in accordance with the present invention.

FIG. 5 depicts a high level flow chart that illustrates receiving a linear digital voice signal and transmitting compressed data utilizing the improved transmit data path of FIG. 3 in accordance with the present invention. The process starts as depicted by block 500 and thereafter passes to block 502 which illustrates receiving a signal in both the mandatory encoder and in the enhanced encoder. Next, block 504 depicts the mandatory encoder encoding the signal. Block 506, then, illustrates the Voice Activity Detector (VAD) that is included in the enhanced encoder analyzing the input signal to determine if voice is present in the signal.

The process then passes to block 508 which depicts a determination of whether or not voice is detected in the signal. If a determination is made that voice is detected, the process passes to block 510 which illustrates the enhanced encoder transmitting a signal to the switch to select the output of the mandatory encoder as the signal output for the transmit data path. The process then passes back to block 502.

Referring again to block 508, if a determination is made that voice is not detected in the signal, the process passes to block 512 which depicts the enhanced encoder sending a signal to the switch to select the output from the enhanced encoder path as the output of the transmit path.

Next, block 514 illustrates the enhanced encoder's internal discontinuous transmission generator (DTX) generating a silence description frame (SID) or an untransmitted silence frame. The output frame will conform to the standards of the enhanced encoder. Thereafter, block 516 illustrates the enhanced encoder SID frame being converted by a SID generator to a standard SID frame that conforms to the mandatory codec standards. The process then passes back to block 502.

FIG. 6 depicts a high level flow chart that illustrates receiving a compressed data signal and transmitting a linear digital voice signal utilizing the improved receive data path of FIG. 4 in accordance with the present invention. The process starts as depicted by block 600 and thereafter passes to block 602 which illustrates receiving a data frame in the frame control logic (FCL) and also at an input switch. Next, block 604 depicts a determination of whether or not the FCL detects the received data frame being a voice frame. If the FCL does detect the received frame as being a voice frame, the process passes to block 606 which illustrates the FCL signaling the input switch and the output switch to select the path of the mandatory decoder. Block 608, then, depicts the mandatory decoder receiving the compressed data frame. Thereafter, block 610 illustrates the mandatory decoder decoding the compressed data to produce a digital voice signal.

The process then passes to block 612 which depicts the decoded data frame being used as the voice output of the receive data path. Next, block 614 illustrates the digital voice signal output from the mandatory decoder being received within the enhanced encoder. Thereafter, block 616 depicts the enhanced encoder encoding the digital voice signal and outputting a compressed data signal, which is the encoded voice signal, to the enhanced encoder. Next, block 618 illustrates the enhanced decoder receiving and decoding the compressed data signal. By receiving and decoding this compressed data signal, the enhanced decoder's internal states are updated. The output of the enhanced decoder is then discarded. The process passes back to block 602.

Referring again to block 604, if a determination is made that the FCL does not detect the received frame as being a voice frame, the process passes to block 620 which illustrates the FCL signaling the input switch and the output switch to select the path of the enhanced decoder. Next block 621 depicts a determination of whether or not the data is a SID frame. If a determination is made that it is a SID frame, then the process passes to block 622. Next, block 622 depicts the SID converter converting the standard SID frame that is compatible with the mandatory encoder to an enhanced encoder SID frame that is compatible with the enhanced encoder. The process then passes to block 624 which illustrates the enhanced decoder receiving the enhanced encoder SID frame. Referring again to block 621, if a determination is made that the data is not a SID frame, the process passes to block 626.

Block 626, then, depicts a determination of whether or not the enhanced decoder detects packet loss in the enhanced encoder SID frame. If a determination is made that the enhanced decoder does not detect packet loss in the enhanced encoder SID frame, the process then passes to block 628 which illustrates the enhanced decoder's internal comfort noise generator (CNG) generating comfort noise. The process then passes to block 630.

Referring again to block 626, if a determination is made that the enhanced decoder does detect packet loss in the enhanced encoder SID frame, the process passes to block 632 which illustrates the enhanced decoder's internal Packet Loss Concealment (PLC) device attempting to generate the missing data. The process then passes to block 630 which depicts the enhanced decoder's output being used as the output of the receive path. The process then passes back to block 602.

Figure 7:
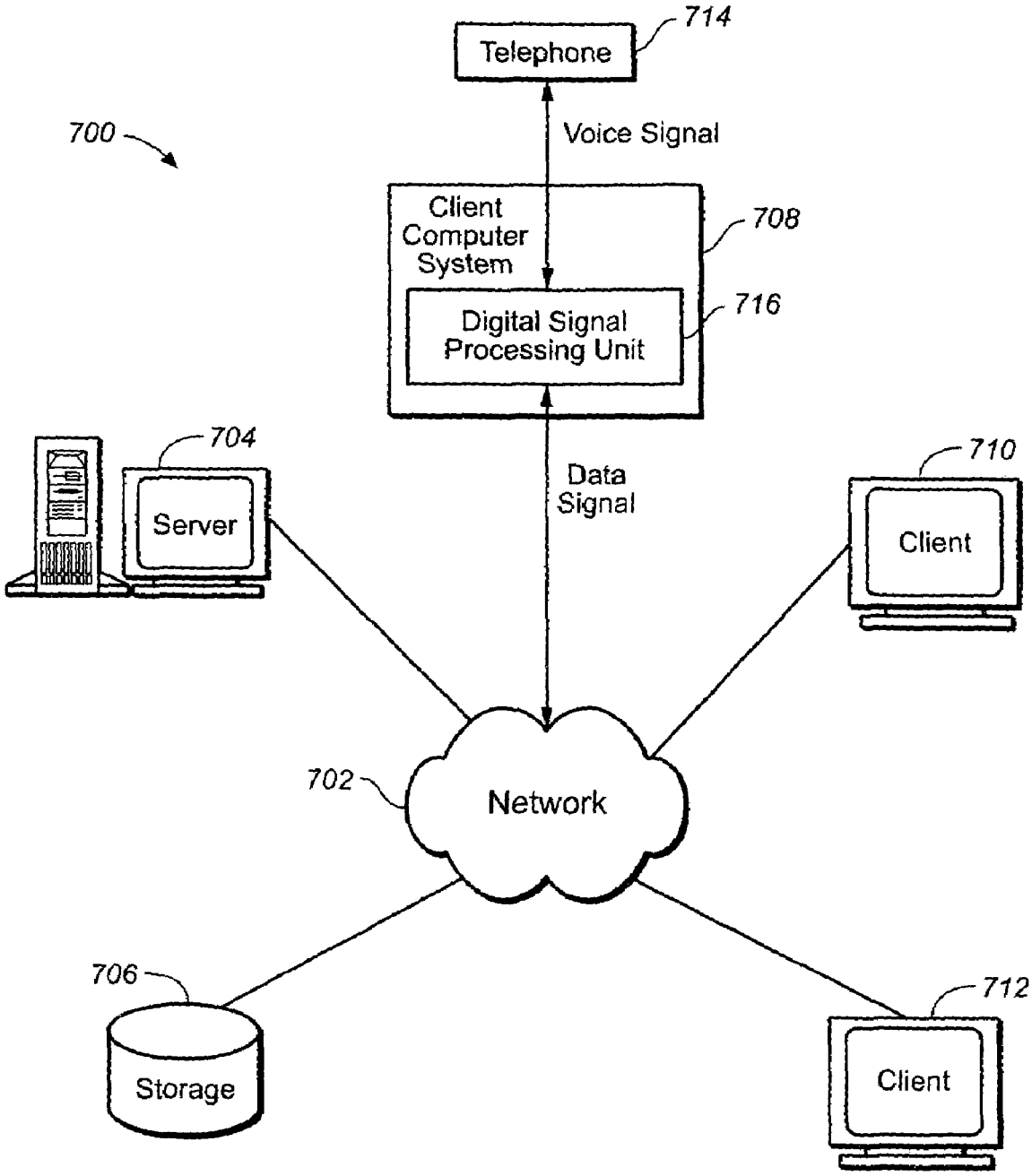
FIG. 7 depicts a network of computer systems that implements the present invention in accordance with the present invention.

FIG. 7 depicts a network of computer systems that implement the present invention in accordance with the present invention. Network data processing system 700 is a network of computers in which the present invention may be implemented. Network data processing system 700 contains a network 702, which is the medium used to provide communications links between various devices and computers connected together within network data processing system 700. Network 702 may include connections, such as wire, wireless communication links, or fiber optic cables.

In the depicted example, a server 704 is connected to network 702 along with storage unit 706. In addition, clients 708, 710, and 712 also are connected to network 702. These clients 708, 710, and 712 may be, for example, personal computers, network computers, or other computing devices. In the depicted example, server 704 provides data, such as boot files, operating system images, and applications to clients 708-712. Clients 708, 710, and 712 are clients to server 704. Network data processing system 700 may include additional servers, clients, and other devices not shown. In the depicted example, network data processing system 700 is the Internet with network 702 representing a worldwide collection of networks and gateways that use the TCP/IP suite of protocols to communicate with one another. At the heart of the Internet is a backbone of high-speed data communication lines between major nodes or host computers, consisting of thousands of commercial, government, educational and other computer systems that route data and messages.

Of course, network data processing system 700 also may be implemented as a number of different types of networks, such as for example, an intranet, a local area network (LAN), a wide area network (WAN), or a wireless network. FIG. 7 is intended as an example, and not as an architectural limitation for the present invention.

Any of these computer systems may be used for VoIP communications. For example, client 708 is used for VoIP communications. Therefore, client 708 may be coupled to a telephone 714 for receiving and outputting an analog voice signal. Client computer system 708 includes a digital signal processing unit 716. DSP 300 and/or DSP 400 may be included within client 708 as part of digital signal processing unit 716.

Figure 8:
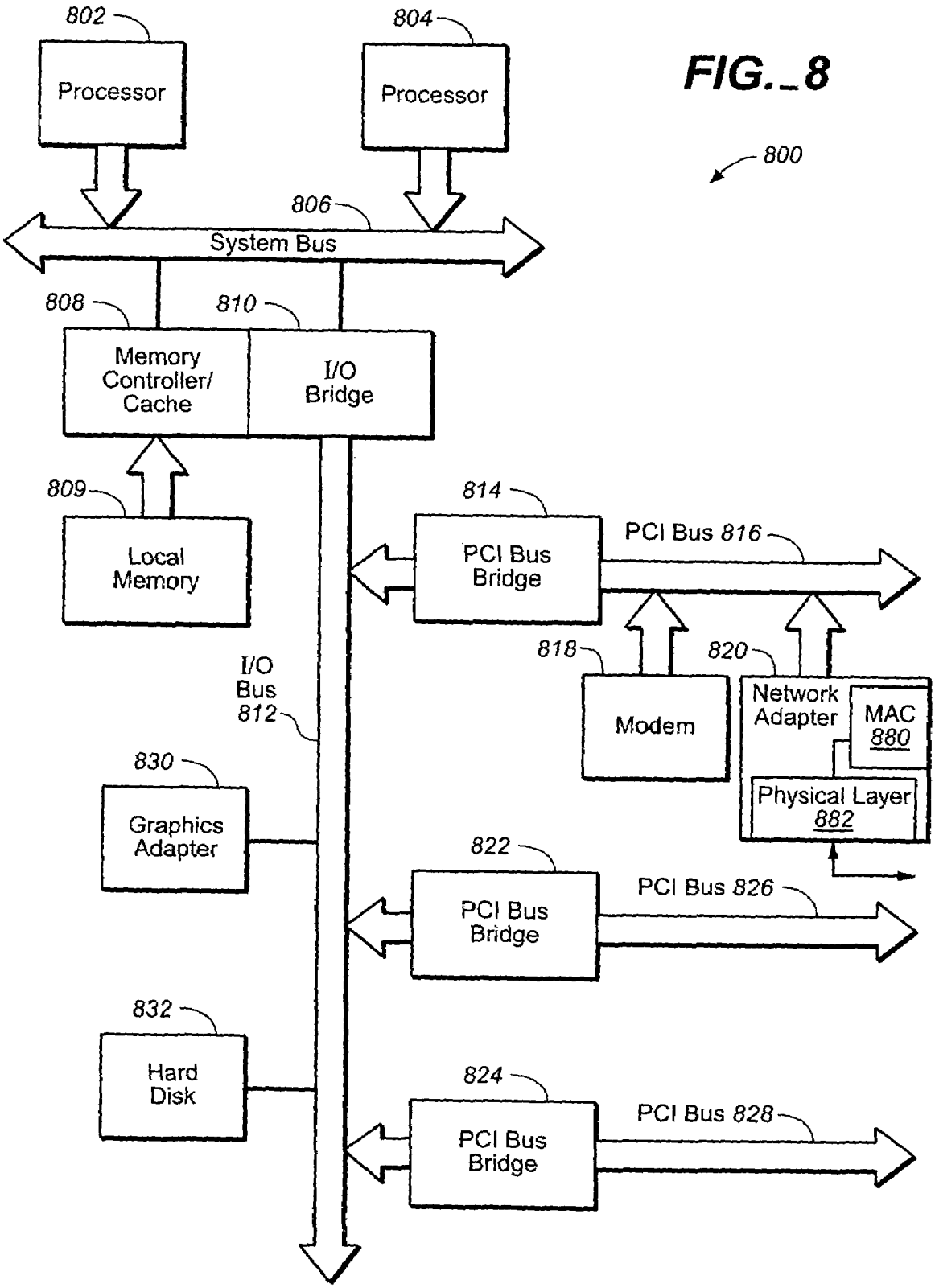
FIG. 8 is a block diagram that illustrates a host computer system that includes the present invention in accordance with the present invention.

FIG. 8 is a more detailed illustration of a computer system that may be used to implement any of the computer systems of FIG. 7 in accordance with the present invention. Data processing system 800 may be a symmetric multiprocessor (SMP) system including a plurality of processors 802 and 804 connected to system bus 806. Alternatively, a single processor system may be employed. Also connected to system bus 806 is memory controller/cache 808, which provides an interface to local memory 809. I/O bus bridge 810 is connected to system bus 806 and provides an interface to I/O bus 812. Memory controller/cache 808 and I/O bus bridge 810 may be integrated as depicted.

Peripheral component interconnect (PCI) bus bridge 814 connected to I/O bus 812 provides an interface to PCI local bus 816. A number of modems may be connected to PCI bus 816. Communications links to network computers 708-712 in FIG. 7 may be provided through modem 818 and network adapter 820 connected to PCI local bus 816 through add-in boards.

Network adapter 820 includes a physical layer 882 which conditions analog signals to go out to the network, such as for example an Ethernet network over an R45 connector. A media access controller (MAC) 880 is included within network adapter 820. Media access controller (MAC) 880 is coupled to bus 816 and processes digital network signals. MAC 880 serves as an interface between bus 816 and physical layer 882. MAC 880 performs a number of functions involved in the transmission and reception of data packets. For example, during the transmission of data, MAC 880 assembles the data to be transmitted into a packet with address and error detection fields. Conversely, during the reception of a packet, MAC 880 disassembles the packet and performs address checking and error detection. In addition, MAC 880 typically performs encoding/decoding of digital signals transmitted and performs preamble generation/removal as well as bit transmission/reception.

Additional PCI bus bridges 822 and 824 provide interfaces for additional PCI buses 826 and 828, from which additional modems or network adapters may be supported. In this manner, data processing system 800 allows connections to multiple network computers. A memory-mapped graphics adapter 830 and hard disk 832 may also be connected to I/O bus 812 as depicted, either directly or indirectly.

It is important to note that while the present invention has been described in the context of a fully functioning data processing system. Those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method in a data processing system that includes a Voice over Internet Protocol (VoIP) communication system for improving transmit and receive data paths, said method comprising the steps of:

said communication system including a digital signal processing unit, wherein the digital signal processing unit includes a mandatory coder/decoder (codec) that does not include an internal packet loss concealment (PLC) function, an internal voice activity detection (VAD) function, an internal comfort noise generation (CNG) function, or an internal discontinuous transmission generation (DTX) function;

said digital signal processing unit including an enhanced codec, wherein the enhanced codec includes the internal PLC function, the internal VAD function, the internal CNG function, and the internal DTX function;

said digital signal processing unit not including a separate packet loss concealment (PLC) device, a separate voice activity detection (VAD) device, a separate comfort noise generation (CNG) device, or a separate discontinuous transmission generation (DTX) device;

receiving an input signal;

utilizing the internal VAD function of the enhanced codec to determine whether said input signal includes voice data;

in response to determining that said input signal does include voice data, processing said input signal utilizing said mandatory codec; and in response to determining that said input signal does not include voice data, processing said input signal utilizing said enhanced codec.

2. The method according to claim 1, further comprising:

said digital signal processing unit including a digital signal processor (DSP), said DSP including said enhanced codec and said mandatory codec, wherein said DSP does not include the internal packet loss concealment (PLC) function, the internal voice activity detection (VAD) function, the internal comfort noise generation (CNG) function, or the internal discontinuous transmission generation (DTX) function;

receiving said input signal in a transmit data path in said DSP, said input signal being a linear voice signal;

said enhanced codec being an enhanced encoder;

receiving said input linear voice signal in both said mandatory codec and said enhanced encoder;

encoding said input linear voice signal utilizing said mandatory codec;

encoding said input linear voice signal utilizing said enhanced encoder;

determining whether said input linear voice signal includes voice;

in response to a determination that said input linear voice signal includes voice, using an output of said mandatory codec as an output of said transmit path; and in response to a determination that said input linear voice signal does not include voice, using an output of said enhanced encoder as an output of said transmit path, said output of said transmit path being a compressed data signal.

3. The method according to claim 2, further comprising:

utilizing said internal VAD in said enhanced encoder to determine whether said input linear voice signal includes voice, wherein no device or process that is separate from said enhanced encoder is used to determine whether said input linear voice signal includes voice.

4. The method according to claim 3, further comprising:

in response to a determination that said input linear voice signal includes voice, signaling an output select switch to select said output of said mandatory codec as an output of said transmit path, said output of said transmit path being a compressed data signal; and in response to a determination that said input linear voice signal does not include voice, signaling said output select switch to select said output of said enhanced encoder as an output of said transmit path, said output of said transmit path being a compressed data signal.

5. The method according to claim 2, further comprising:

generating a silence description (SID) frame that conforms to the standards of the enhanced encoder utilizing said DTX in said enhanced encoder.

6. The method according to claim 5, further comprising:

converting said SID frame that conforms to the standards of the enhanced encoder to a converted SID frame that conforms to the standards of the VoIP communication system; and in response to a determination that said input linear voice signal does not include voice, using said converted SID frame as said output of said transmit path, said output of said transmit path being a compressed data signal.

7. The method according to claim 1, further comprising:

said digital signal processing unit including a digital signal processor (DSP), said DSP including said enhanced codec and said mandatory codec, wherein said DSP does not include an internal packet loss concealment (PLC) function, an internal voice activity detection (VAD) function, an internal comfort noise generation (CNG) function, or an internal discontinuous transmission generation (DTX) function;

receiving said input signal in a receive data path in said DSP, said input signal being a compressed data signal;

said enhanced codec including an enhanced encoder that includes an internal voice activity detection (VAD) function, and an internal discontinuous transmission generation (DTX) function;

said enhanced codec including an enhanced decoder;

determining whether said compressed data input signal includes voice;

in response to a determination that said compressed data input signal includes voice, using an output of said mandatory codec as an output of said receive path; and in response to a determination that said compressed data input signal does not include voice, using an output of said enhanced decoder as an output of said receive path, said output of said receive path being a linear voice signal.

8. The method according to claim 7, further comprising:

in response to a determination that said compressed data input signal includes voice, signaling an output select switch to select said output of said mandatory codec as an output of said receive path, said output of said receive path being a linear voice signal; and in response to a determination that said compressed data input signal does not include voice, signaling said output select switch to select said output of said enhanced decoder as an output of said receive path, said output of said receive path being a linear voice signal.

9. The method according to claim 7, further comprising:

in response to a determination that said compressed data input signal does not include voice, determining whether said compressed data input signal is a silence description (SID) frame;

in response to a determination that said compressed data input signal is not an SID frame, determining, utilizing said internal PLC in said enhanced decoder, whether packet loss has occurred in said compressed data input signal; and in response to determining that packet loss has occurred, attempted, by said internal PLC, to generate missing data.

10. The method according to claim 9, further comprising:

in response to determining that packet loss has not occurred, generating, by said internal CNG, comfort noise in said output signal of said enhanced decoder.

11. The method according to claim 9, further comprising:

in response to a determination that said compressed data input signal is an SD frame, converting said SID frame that conforms to the standards of said mandatory decoder to a converted SID frame that conforms to the standards of said enhanced decoder.

12. The method according to claim 7, further comprising:

in response to a determination that said compressed data input signal does include voice, receiving said output of said mandatory decoder in said enhanced encoder;

generating a compressed data signal output from said enhanced encoder;

receiving said compressed data signal output from said enhanced encoder within said enhanced decoder;

generating a linear voice data signal output from said enhanced decoder;

discarding said linear voice data signal output from said enhanced decoder; and said process of receiving said compressed data signal and generating said linear voice data signal utilizing said enhanced decoder resets internal registers within said enhanced decoder.

13. An apparatus in a data processing system that includes a Voice over Internet Protocol (VoIP) communication system for improving transmit and receive data paths, said apparatus comprising:

said communication system including a digital signal processing unit, wherein the digital signal processing unit includes a mandatory coder/decoder (codec) that does not include an internal packet loss concealment (PLC) function, an internal voice activity detection (VAD) function, an internal comfort noise generation (CNG) function, or an internal discontinuous transmission generation (DTX) function;

said digital signal processing unit including an enhanced codec, wherein the enhanced codec includes the internal PLC function, the internal VAD function, the internal CNG function, and the internal DTX function;

said digital signal processing unit not including a separate packet loss concealment (PLC) device, a separate voice activity detection (VAD) device, a separate comfort noise generation (CNG) device, or a separate discontinuous transmission generation (DTX) device;

an input signal being received within said digital signal processing (DSP) unit;

the internal VAD function of the enhanced codec utilizing said DSP unit to determine whether said input signal includes voice data;

in response to determining that said input signal does include voice data, said mandatory codec processing said input signal; and in response to determining that said input signal does not include voice data, said enhanced codec processing said input signal.

14. The apparatus according to claim 13, further comprising:

said digital signal processing unit including a digital signal processor (DSP), said DSP including said enhanced codec and said mandatory codec, wherein said DSP does not include an internal packet loss concealment (PLC) function, an internal voice activity detection (VAD) function, an internal comfort noise generation (CNG) function, or an internal discontinuous transmission generation (DTX) function;

a transmit data path in said DSP receiving said input signal, said input signal being a linear voice signal;

said enhanced codec being an enhanced encoder;

both said mandatory codec and said enhanced encoder receiving said input linear voice signal;

said mandatory codec encoding said input linear voice signal;

said enhanced encoder encoding said input linear voice signal;

said DSP unit determining whether said input linear voice signal includes voice;

in response to a determination that said input linear voice signal includes voice, an output of said mandatory codec being an output of said transmit path; and in response to a determination that said input linear voice signal does not include voice, an output of said enhanced encoder being an output of said transmit path, said output of said transmit path being a compressed data signal.

15. The apparatus according to claim 14, further comprising:

said internal VAD in said enhanced encoder determining whether said input linear voice signal includes voice, wherein no device or process that is separate from said enhanced encoder is used to determine whether said input linear voice signal includes voice.

16. The apparatus according to claim 15, further comprising:

in response to a determination that said input linear voice signal includes voice, an output select switch selecting said output of said mandatory codec as an output of said transmit path, said output of said transmit path being a compressed data signal; and in response to a determination that said input linear voice signal does not include voice, said output select switch selecting said output of said enhanced encoder as an output of said transmit path, said output of said transmit path being a compressed data signal.

17. The apparatus according to claim 14, further comprising:

a silence description (SID) frame that conforms to the standards of the enhanced encoder being generated utilizing said DTX in said enhanced encoder.

18. The apparatus according to claim 17, further comprising:

said SID frame that conforms to the standards of the enhanced encoder being converted to a converted SID frame that conforms to the standards of the VoIP communication system; and in response to a determination that said input linear voice signal does not include voice, said converted SID frame being said output of said transmit path, said output of said transmit path being a compressed data signal.

19. The apparatus according to claim 13, further comprising:

said digital signal processing unit including a digital signal processor (DSP), said DSP including said enhanced codec and said mandatory codec, wherein said DSP does not include an internal packet loss concealment (PLC) function, an internal voice activity detection (VAD) function, an internal comfort noise generation (CNG) function, or an internal discontinuous transmission generation (DTX) function;

said input signal being received in a receive data path in said DSP, said input signal being a compressed data signal;

said enhanced codec including an enhanced encoder;

said enhanced code including an enhanced decoder, said enhanced decoder including an internal packet loss concealment (PLC) function, and an internal comfort noise generation (CNG) function;

said DSP unit determining whether said compressed data input signal includes voice;

in response to a determination that said compressed data input signal includes voice, an output of said mandatory codec being an output of said receive path; and in response to a determination that said compressed data input signal does not include voice, an output of said enhanced decoder being an output of said receive path, said output of said receive path being a linear voice signal.

20. The apparatus according to claim 19, further comprising:

in response to a determination that said compressed data input signal includes voice, an output select switch selecting said output of said mandatory codec as an output of said receive path, said output of said receive path being a linear voice signal; and in response to a determination that said compressed data input signal does not include voice, said output select switch selecting said output of said enhanced decoder as an output of said receive path, said output of said receive path being a linear voice signal.

21. The apparatus according to claim 19, further comprising:

in response to a determination that said compressed data input signal does not include voice, said DSP unit determining whether said compressed data input signal is a silence description (SID) frame;

in response to a determination that said compressed data input signal is not an SID frame, said internal PLC in said enhanced decoder determining whether packet loss has occurred in said compressed data input signal; and in response to determining that packet loss has occurred, said internal PLC attempting to generate missing data.

22. The apparatus according to claim 21, further comprising:

in response to determining that packet loss has not occurred, said internal CNG generating comfort noise in said output signal of said enhanced decoder.

23. The apparatus according to claim 21, further comprising:

in response to a determination that said compressed data input signal is an SD frame, said SID frame that conforms to the standards of said mandatory decoder being converted to a converted SID frame that conforms to the standards of said enhanced decoder.

24. The apparatus according to claim 19, further comprising:

in response to a determination that said compressed data input signal does include voice, said output of said mandatory decoder being received in said enhanced encoder;

said enhanced encoder generating a compressed data signal output;

said enhanced decoder receiving said compressed data signal output from said enhanced encoder;

said enhanced decoder generating a linear voice data signal output;

said linear voice data signal output from said enhanced decoder being discarded; and internal registers within said enhanced decoder being reset by said process of receiving said compressed data signal and generating said linear voice data signal.

* * * * *